US005088421A

United States Patent [19]

Beckstead

[11] Patent Number: 5,088,421

[45] Date of Patent: Feb. 18, 1992

[54] ADJUSTABLE HEIGHT DESK

[76] Inventor: Douglas S. Beckstead, 139 Burke La., Kneeland, Calif. 95549

[21] Appl. No.: 569,333

[22] Filed: Aug. 20, 1990

[51] Int. Cl.[5] ..... A47B 9/12

[52] U.S. Cl. ..... 108/144; 108/147; 248/406.1; 312/312

[58] Field of Search ..... 108/144, 147; 248/405, 248/406.1, 157; 312/312

[56] References Cited

U.S. PATENT DOCUMENTS

| | | | |
|---|---|---|---|
| 1,943,280 | 1/1934 | Arnold | 108/147 |
| 2,931,685 | 4/1960 | Butler | 312/312 X |
| 2,944,861 | 7/1960 | Lessin | 312/312 |
| 3,415,586 | 12/1968 | Hammond | 312/312 |
| 3,587,482 | 6/1971 | Wieland | 108/147 |
| 4,593,874 | 6/1986 | Dunagan | 108/147 X |

*Primary Examiner*—Peter A. Aschenbrenner
*Attorney, Agent, or Firm*—Henderson & Sturm

[57] ABSTRACT

An adjustable height desk including an open-front base and an outer skirting disposed over and around the base. Corner support brackets secured to the skirting below the work surface support threaded shafts. The lower end of each shaft is received and supported in a threaded nut positioned over hollow center channels formed in the support legs of the open-front base. The upper end of each shaft carries a sprocket that engages a continuous drive chain driven by a reversible motor. Selective activation of the motor moves the skirting, including the work surface, in a 21 inch range between the lowered seated position and the raised standing position.

6 Claims, 2 Drawing Sheets

ADJUSTABLE HEIGHT DESK

TECHNICAL FIELD

This invention relates to work desks, and more particularly to a work desk having a vertically adjustable work surface.

BACKGROUND ART

The need for vertical adjustment of a work surface for a work desk has long been recognized. Both the productivity and the comfort level of the user are increased if the height of the work surface can be adjusted to fit the needs of a particular individual. Elaborate arrangements for such height adjustments have long been prevalent in such diverse areas as operating tables and drafting tables. In most cases, however, the adjustment has either been for a relatively small vertical travel or for adjustment to one of two distinct vertical positions, or has been elaborate and costly. The adjustments provided are considered inadequate by users due to lack of flexibility.

For some jobs the ability to switch between the standing and sitting position acts to relieve fatigue and improve productivity. If a work desk is to be used from either the standing or the sitting position, it is necessary to make a substantial vertical adjustment of the height of the work surface. It is also desirable to have a nearly continuous vertical adjustment to provide the optimum surface height for any user. To meet this need, a work desk capable of continuous adjustment of the height of the work surface of about 20 inches with minimum adjustment effort and cost is needed.

A further problem encountered in adjustable work desks is that of achieving vertical motion without encountering a tendency to jam. When the side supports are too tight, there will be a tendency for the work surface to jam when adjusted. When the side supports are not tight enough, there will be excessive play in the position of the work surface when it has been adjusted to the desired height.

Those concerned with these and other problems recognize the need for an improved adjustable height desk.

DISCLOSURE OF THE INVENTION

The present invention provides an adjustable height desk including an open-front base and an outer skirting disposed over and around the base. Corner support brackets secured to the skirting below the work surface support threaded shafts. The lower end of each shaft is received and supported in a threaded nut positioned over hollow center channels formed in the support legs of the open-front base. The upper end of each shaft carries a sprocket that engages a continuous drive chain driven by a reversible motor. Selective activation of the motor moves the skirting, including the work surface, in a 21 inch range between the lowered seated position and the raised standing position.

An object of the present invention is the provision of an improved adjustable height desk.

Another object is to provide a desk which has a work surface that is infinitely adjustable between a lowered and a raised position.

A further object of the invention is the provision of an adjustable height desk having simultaneous and equal adjustment of all support members.

Still another object is to provide an adjustable height desk that is easy and convenient to use.

A still further object of the present invention is the provision of an adjustable height desk that is uncomplicated in design and easy to maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
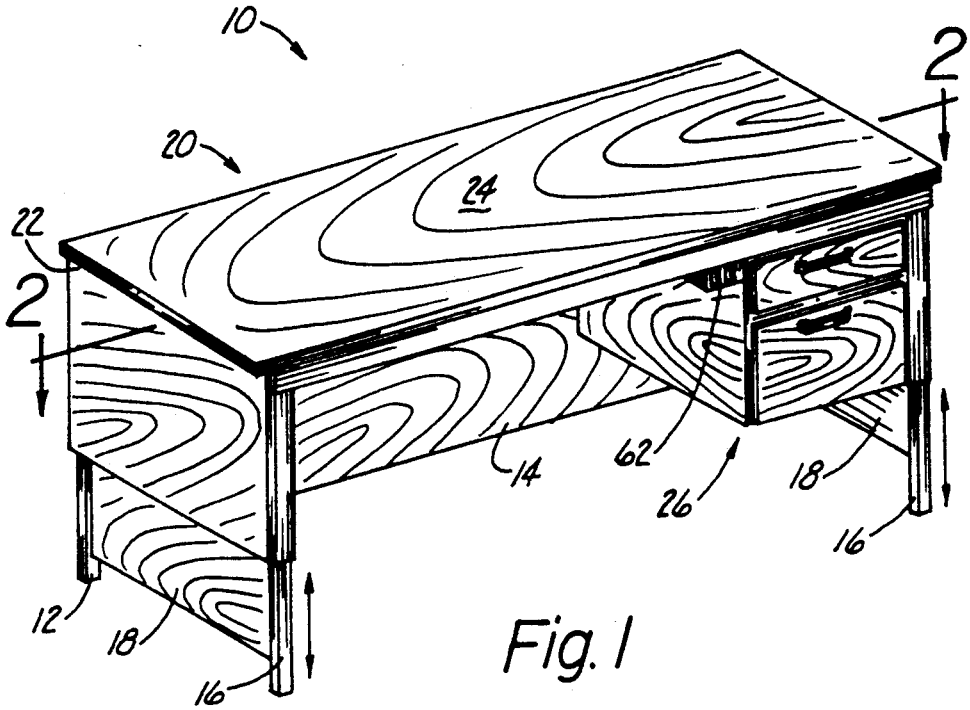
FIG. 1 is a perspective view of the adjustable height desk of the present invention wherein directional arrows indicate the movement between a lowered seated position and a raised standing position.

Referring now to the drawings, wherein like reference numerals designate identical or corresponding parts throughout the several views, FIG. 1 shows the adjustable height desk (10) of the present invention. The desk (10) includes an open front base having rear support legs (12) connected by a rear panel (14), and front support legs (16) attached to the rear support legs (12) by side panels (18). An outer surround or skirting (20) extends over and around the open front base including the front support legs (16). The skirting (20) includes an upper edge (22) that receives and supports a horizontal work surface (24). Storage drawers (26) are attached to and are supported on one side of the skirting (20). As illustrated by the directional arrows in FIG. 1, the skirting (20) is movable between a lowered seated position and a raised standing position.

Figure 3:
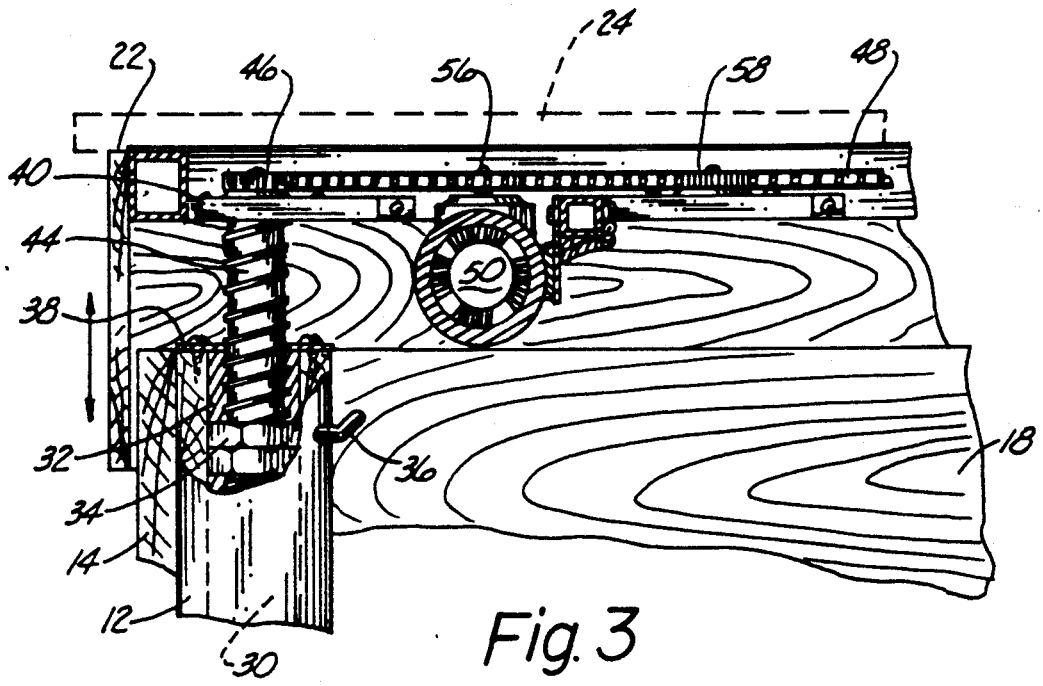
FIG. 3 is an enlarged sectional view taken along line 3—3 of FIG. 1 showing the threaded shaft received by the nut secured in the support leg over the hollow center channel.

Referring now to FIG. 3, the rear support leg (12) is shown having a hollow center channel (30). It is to be understood that both rear support legs (12) and both front support legs (16) include the hollow channel (30) and the associated structure shown in FIG. 3. A ball screw unit (32) and a shoulder rest (34) are secured at the top of the hollow channel (30) by a retainer pin (36). A plastic dust cover (38) is attached by wood screws to the top edge of the support leg (12).

Figure 4:
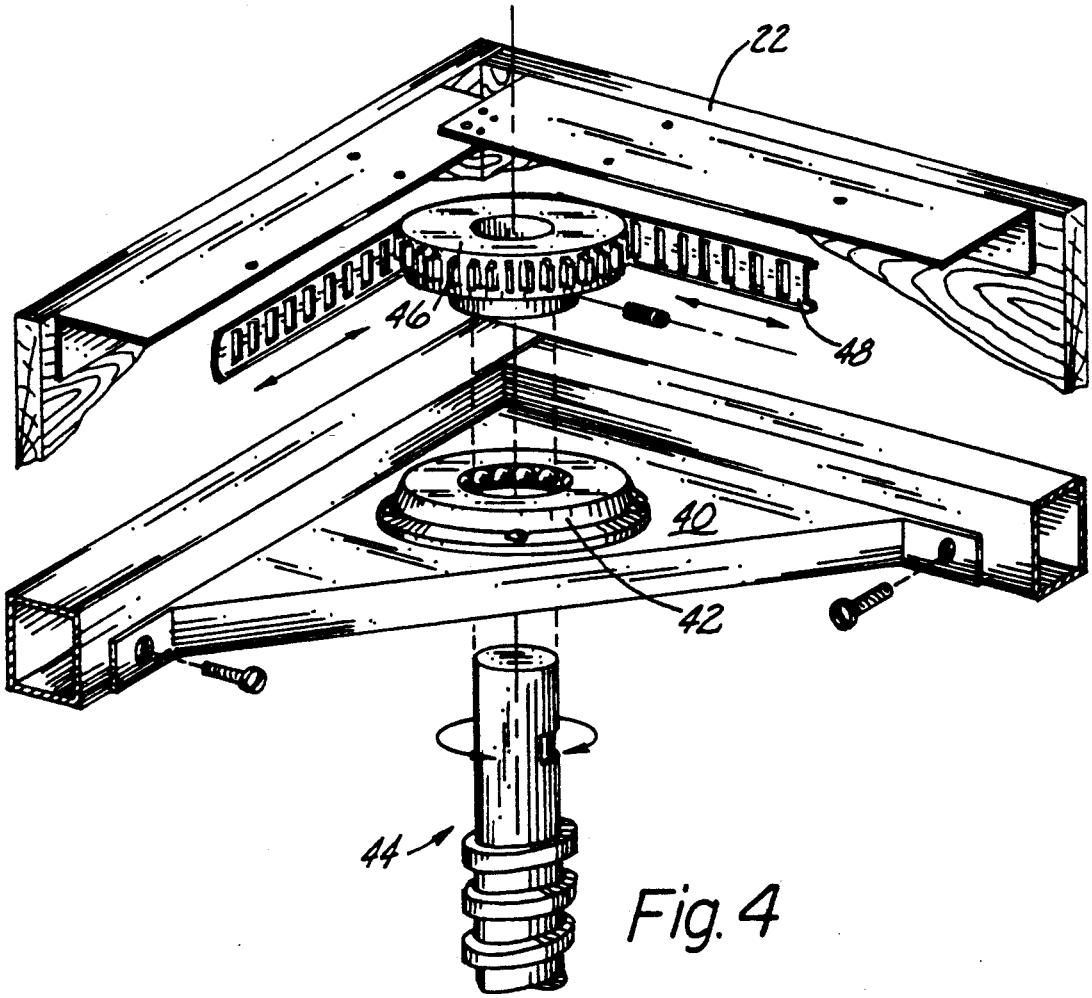
FIG. 4 is an enlarged exploded partial perspective view illustrating the position of the sprocket and threaded shaft with respect to the corner support bracket.

As best shown in FIG. 4, a corner support bracket (40) is attached to each of the four corners of the skirting (20) adjacent the top edge (22). A bearing (42) is supported by each of the brackets (40) to rotatably receive a threaded ball screw shaft (44). The lower end of the shaft (40) engages the nuts (32, 34) in the corresponding support leg (12, 16) and the upper end of the shaft (40) carries a drive sprocket (46). A continuous drive chain (48) drivably engages each of the sprockets (46).

Figure 2:
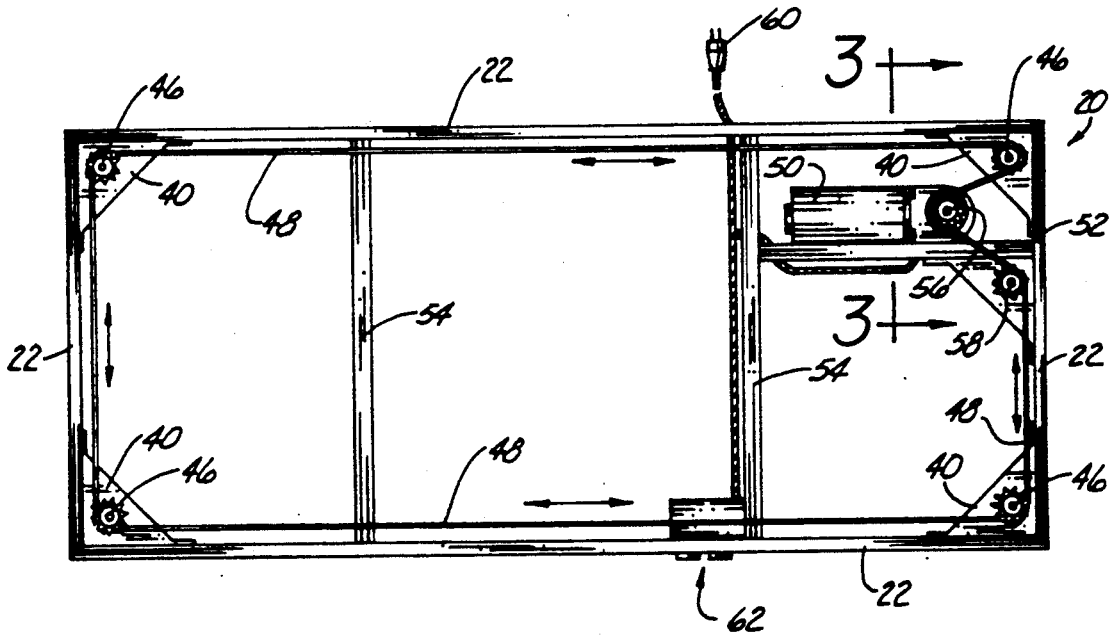
FIG. 2 is a top plan sectional view taken along line 2—2 of FIG. 1 showing the position of the drive sprockets and the continuous drive chain located below the work surface of the desk.

Referring now to FIGS. 2 and 3, a reversible electric motor (50) is secured to a motor support arm (52) which extends between the skirting (20) and a transverse arm (54). The output shaft of the motor (50) carries a sprocket (56) disposed at the elevation of the drive sprockets (46). An idler sprocket (58) is disposed to engage the continuous chain (48) and maintain it in tension. The motor (50) is adapted to be powered from a conventional wall receptacle by wall plug (60), and the direction of rotation of the motor (50) is controlled by a switch (62) mounted at the front of the skirting (20).

In operation, the height of the desk (10) is simply and conveniently adjusted by activation of the motor (50) with the switch (62). When activated, the motor (50) simultaneously drives all of the drive sprockets (46) so that the skirting (20) is uniformly raised and lowered. The range of elevation between the fully lowered seated position and fully raised standing position is approximately 21 inches. This large range of movement, together with the infinite height adjustment makes the desk (10) suitable for a variety of purposes.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. An adjustable height desk, comprising:

an open front base including rear support legs interconnected by a rear panel, and front support legs attached to the rear support legs by side panels, each of the front and rear support legs having a hollow center channel and a threaded nut secured to the support leg and disposed over the hollow channel;

an outer skirting disposed to extend over and being spaced outwardly from the entire exterior of the open front base including the front support legs, the skirting including an upper edge disposed to receive and support a horizontal work surface, the skirting being movable between a lowered seated position and a raised standing position;

corner support brackets attached to the skirting below the work surface and disposed above each of the support legs;

a threaded shaft rotatably attached to each support bracket, the shaft having a lower end disposed to engage the threaded nut of the corresponding support leg and an upper end disposed to receive a drive sprocket;

a continuous drive chain disposed to drivably engage each of said drive sprockets; and reversible drive means for simultaneously driving the drive sprockets to selectively move the outer skirting between the lowered seated position and the raised standing position.

2. The desk of claim 1 wherein the reversible drive means is a reversible electric motor mounted to the skirting below the work surface.

3. The desk of claim 2 wherein the electric motor is selectively actuated by a switch mounted on the front of the skirting below the work surface.

4. The desk of claim 3 further including an idler sprocket attached to the skirting and disposed to engage the continuous chain to maintain the chain in tension.

5. The desk of claim 1 further including storage drawers attached to and supported by the skirting and being movable therewith.

6. An adjustable height desk, comprising:

an open front base including rear support legs interconnected by a rear panel, and front support legs attached to the rear support legs by side panels, each of the front and rear support legs having a hollow center channel and a threaded nut secured to the support leg and disposed over the hollow channel;

an outer skirting disposed to extend over and being disposed outwardly from the entire exterior of the open front base including the front support legs, the skirting including an upper edge disposed to receive and support a horizontal work surface, and storage drawers attached to and disposed adjacent a side of the skirting, the skirting being movable between a lowered seated position and a raised standing position;

triangular corner support brackets attached to the skirting below the work surface adjacent the upper edge and disposed immediately above each of the support legs, each of the support brackets carrying a bearing;

a threaded shaft rotatably attached by the bearing to each support bracket, the shaft having a lower end disposed to engage the threaded nut of the corresponding support leg and an upper end disposed to receive a drive sprocket, each of the drive sprockets being disposed at substantially the same elevation;

reversible drive means for simultaneously driving the drive sprockets to selectively move the outer skirting between the lowered seated position and the raised standing position, the drive means including a reversible electric motor mounted to the skirting below the work surface and directly behind the storage drawers, and an output sprocket attached to an output shaft of the motor, the output sprocket being disposed at substantially the same elevation as the drive sprockets;

an idler sprocket attached to the skirting below the work surface disposed at substantially the same elevation as the drive sprockets and the output sprocket;

a continuous flat cable drive chain operably attached to the output sprocket and disposed to drivably engage the idler sprocket and each of said drive sprockets, said drive chain being disposed to extend around the upper edge of the skirting in a substantially rectangular level path immediately below the horizontal work surface; and a switch mounted on the front of the skirting below the work surface and adjacent the storage drawers, the switch being operably connected to the reversible electric motor to selectively control the elevation of the work surface at a position between the lowered seated position and the raised standing position.

* * * * *